United States Patent [19]

Kullberg

[11] Patent Number: 4,611,753

[45] Date of Patent: Sep. 16, 1986

[54] CLOSURE ON A RECTANGULAR CONTAINER FOR STORING OF LIQUID

[76] Inventor: Wilhelm Kullberg, Kjaerlighetsstien 22, N-1751 Halden, Norway

[21] Appl. No.: 756,513

[22] PCT Filed: Nov. 15, 1984

[86] PCT No.: PCT/NO84/00052

§ 371 Date: Jul. 11, 1985

§ 102(e) Date: Jul. 11, 1985

[87] PCT Pub. No.: WO85/02162

PCT Pub. Date: May 23, 1985

[30] Foreign Application Priority Data

Nov. 15, 1983 [NO] Norway ..... 834174
Oct. 24, 1984 [NO] Norway ..... 844237

[51] Int. Cl.[4] ..... B65D 5/74

[52] U.S. Cl. ..... 229/17 R; 229/120; 229/137; 229/155

[58] Field of Search ..... 229/17 R, 17 G, 37 R, 229/38, 39 R

[56] References Cited

U.S. PATENT DOCUMENTS

| | | | |
|---|---|---|---|
| 681,323 | 8/1901 | Houghland | 229/37 R |
| 2,034,594 | 3/1936 | Norris et al. | 229/17 R |
| 2,337,730 | 12/1943 | Berch | 229/17 R |
| 3,081,927 | 3/1963 | Hayhurst | 229/17 R |
| 3,118,586 | 1/1964 | Kelly | 229/17 G |
| 3,281,048 | 10/1966 | Koltz et al. | 229/17 R |
| 3,985,287 | 10/1976 | Stetler | 229/17 R |
| 4,422,570 | 12/1983 | Lisiecki | 229/17 R |

FOREIGN PATENT DOCUMENTS

| | | | |
|---|---|---|---|
| 700576 | 12/1964 | Canada | 229/17 R |
| 126853 | 1/1974 | Denmark | 229/17 R |
| 599377 | 10/1959 | Italy | 229/38 |
| 211223 | 2/1967 | Sweden | 229/17 R |
| 371984 | 12/1974 | Sweden | 229/17 R |

*Primary Examiner*—George E. Lowrance
*Assistant Examiner*—Gary E. Elkins
*Attorney, Agent, or Firm*—Brumbaugh, Graves, Donohue & Raymond

[57] ABSTRACT

A closure on a rectangular container for storing liquid, having a continuous folding line as the lower limitation of the closure and similar first and second faces, as well as third and fourth faces, the faces having a free edge and being connected with each other and protruding from the continuous folding line, the first and second faces both including folding lines extending from the ends of the continuous folding line on each face to the middle of the free edge of the faces, whereby the fourth face is sealingly connected with the first and second faces, and the third face is adapted to be folded over a remaining part of the first and second faces, whereby the length of the fourth face perpendicular to the continuous folding line is shorter than half of the distance between the corresponding opposite sides of the container, thereby providing an air opening to the interior of the container between the free edge of the fourth face and inwardly protruding peaks of the first and second faces, the free edge of the third face being provided with an extension in the middle, which when the closure is sealed is arranged above the fourth face, and when the closure is opened provides a non-drip spout, and the joint of the side walls of the container being arranged in a symmetrical axis of the third face.

4 Claims, 6 Drawing Figures

CLOSURE ON A RECTANGULAR CONTAINER FOR STORING OF LIQUID

Figure 1:
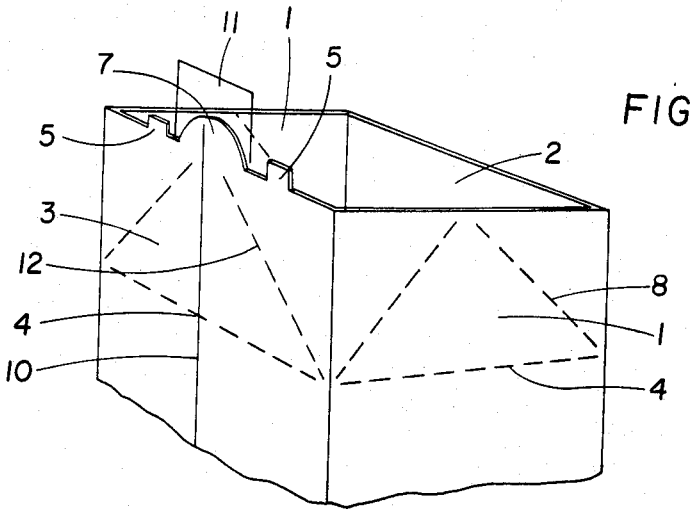

This invention is related to a closure on a rectangular container for storing liquid.

In the market there exists a great number of closure designs for rectangular containers, including square containers, which can be sealed in such a way that the container is well suited for accomodation of liquids of different kinds.

The demands on such containers are connected with different phases of treatment through which they continuously pass. In this connection demands must be met with respect to the configuration of the blank of the container for achieving a suitable manufacture, the producer of the content has to rely on the possibility for a secure sealing of the container and a suitable industrial treatment, by transportation of the containers from the manufacturer a maximum utilization of the transport volume must be possible and finally it should be easy for the consumer to open the container to pour the contents out of it in a secure way, and in most cases it should be possible to close the container for further use. Especially, considerations must be given to the fact that many consumers have relatively weak fingers which create big problems in opening several of the present container types on the market today.

Among known containers for storage of liquids, especially milk and refreshing drinks, three principally different kinds are wide spread. One type is manufactured by planar welding of a tubular container having two welds perpendicular and remote each other in such a way that a tetrahedron is created. As such the configuration of a tetrahedron makes it possible to be placed in a stack but it is not very suitable for the consumer or in connection with transportation or storing which normally is based on a rectangular configuration.

Containers having rectangular configurations achieved by two parallel weldings on a tubular container also are known. In this case the ends of the weldings thereafter are bent down, respectively up, around the side surfaces of the container. The possibility to be placed in a stack is good, however, the configuration requires tearing off or cutting off at least one of the protruding ends of the weldings which for the consumer creates an unfavourable device for pouring in addition to the inconvenience with cutting or tearing off the ends.

In a third principle solution two opposite side surfaces are pressed together having the other opposite side surfaces folded between. Hereby a reasonable convenient configuration is achieved in connection with pouring the liquid out of the container. The configuration of the closure may be such that the closure creates a planar surface or a roof ridge form. In both cases the solutions existing in the market have shown that a relatively large force must be provided to tear off the welding after sealing. The roof ridge form which at some places is relatively wide spread, additionally is unsatisfactory in connection with transportation and storage as it does not allow stacking of several containers on each other and the closure as such occupies a relatively large volume which cannot be used, corresponding as much as up to 40% of the total height of the container.

The above-mentioned disadvantages are avoided by the closure according to the invention which enables stacking of several containers above each other, economical transportation and storage, very simple opening of the container closure, a guided pouring of the content, which avoids a mess of the liquid and which further makes possible a locking of the closure for later use.

These advantages by the closure according to the invention are achieved by the features described in the characterizing clauses of the claims.

Figure 4:
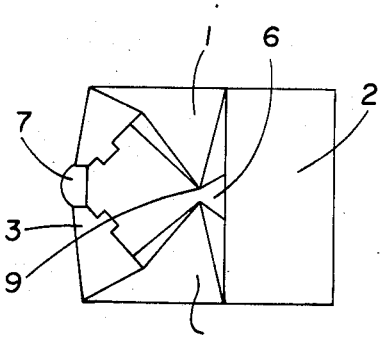
Figure 5:
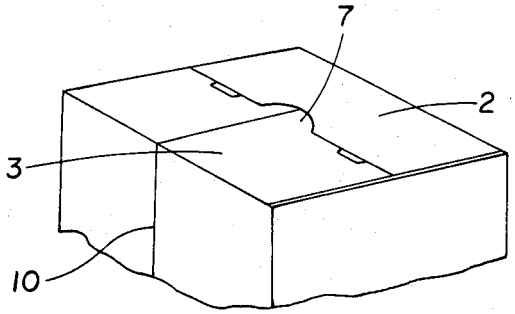
Figure 2:
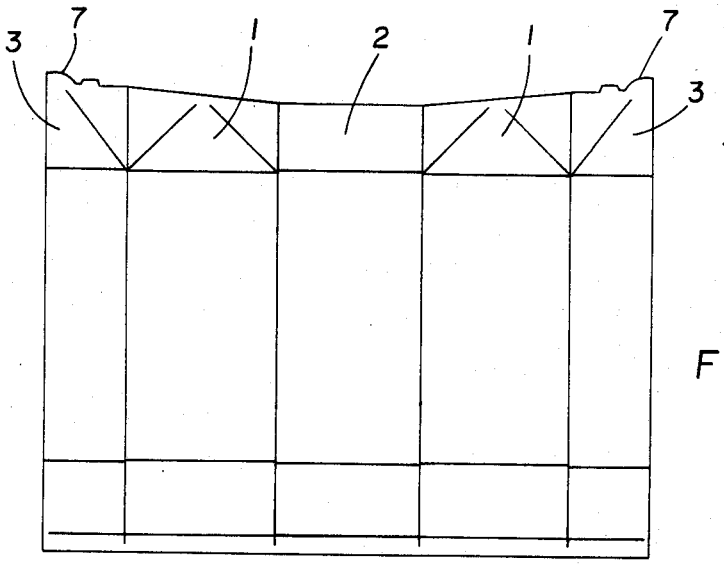
Figure 3:
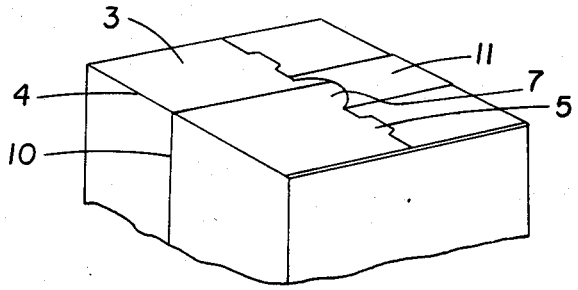
Figure 6:
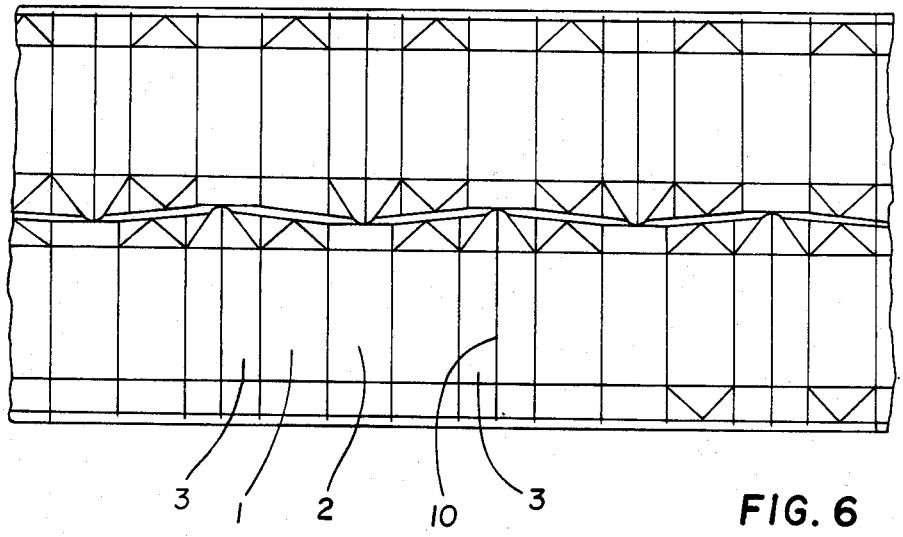

FIG. 1 in the drawing discloses an open closure before sealing,

FIG. 2 discloses a stamped blank for a container,

FIG. 3 discloses the closure after sealing,

FIG. 4 discloses the closure after opening, as seen from above,

FIG. 5 discloses in perspective a closure which is locked after the sealing has been broken, and FIG. 6 discloses blanks for containers arranged for maximum utilization of the material.

FIG. 1 discloses the closure in open position before sealing, where a stamped blank is folded to a tubular structure having an overlap joint 10 in the symmetry axis of one side face. The extension of this face creates a third face 3 in the closure. The third face 3 having in the middle a further extension 7 which later, by pouring liquid out of the container, will serve as a non-drip spout. A tape 11 is located on the underside of the third face 3 and protrudes above the extension. The tape 11; is arranged to cover the joint 10 inside the closure and possibly also in the container.

The third face 3 also comprises two folding lines 12 running from the outer edges of the face from a folding line 4 which is running around all four faces of the container, and further up to the extension 7.

FIG. 1 also discloses that the third face 3 comprises two further extensions which after the first opening of the container, serve as locking lips 5.

The opposite first and second faces 1 are symmetrical and also comprise folding lines 8 from the folding line 4 at the outer edges of the face, up to the upper middle point. The fourth face 2 comprises no folding lines. The length of the fourth face 2 perpendicular to the folding line 4, is smaller than the corresponding length of the third face 3. Therefore, the upper edge of the first and second faces 1 will be bevelled from the third face down to the fourth face.

By sealing the closure first and second faces 1 are folded to the middle and the fourth face 2 is folded above these. Thereafter the third face 3 is folded above the remaining parts of first and second faces 1 and abutting the fourth face 2 in such a way that the extension 7 and the locking lips 5 as well as the tape 11 are arranged on the upper surface of the fourth face 2. The tape 11 is releasably secured to the upper surface of the fourth face 2.

The closure may be sealed by providing a backing tool from the inside of the container, whereby the container is filled with liquid from the bottom, which thereafter is sealed.

By opening of the closure the outer part of the tape 11 is pulled straight upwards in the direction of the container. Thereby the sealing of the third face 3 is broken and this face is folded up together with the extension 7 and the locking lips 5. The tape 11 easily is torn off by means of an attenuation line across the longitudinal direction of the tape, arranged between the extension 7 and the folding line 4 on the third face 3. The tape 11 thereafter can be thrown away.

The closure hereby is prepared for pouring out the content of the container whereby a suitable pouring device is achieved by the extension 7 as a non-drip spout, as well as an opening 6 for air which from the first moment provides admittance for air to the internal part of the container. The air opening 6 is provided between the upper edge of the fourth face 2 and the inner peaks 9 of first and second faces 1.

If the container should be used also afterwards, the closure may be locked by folding the third face 3 against the fourth side face 2 and pressing the locking lips 5 below the edge of the fourth face 2 by a light finger pressure against the third face 3, near the locking lips 5.

Also the extension 7 may be used for locking the closure by pressing the extension 7 below the edge of the fourth face 2. By a further embodiment of the invention only this extension 7 is used for locking the closure and the closure as such does not have any locking lips 5.

Opening of the closure is very easily performed by gripping the outer side edges of the third face 3 and lifting this up.

FIG. 6 discloses that the configuration of the blank for the container including the closure according to the invention, provides very good utilization of the material.

I claim:

1. A closure on a rectangular container with a first pair and a second pair of opposite side walls connected by a single joint for storing of liquid, and having a continuous folding line as the lower limitation of the closure and similar first and second faces provided respectively on the first pair of opposite side walls, as well as third and fourth faces provided respectively on the second pair of opposite side walls, said four faces each having a free edge and being connected with each other so as to protrude from the folding line, said first and second faces both including folding lines extending from ends of the continuous folding line on each face to the middle of the free edge of each face so that said fourth face is foldable over a part of said first and second faces, the fourth face connected with said first and second faces by a permanent seal, the third face connected to said first and second faces by a releasable seal whereby the third face forms a spout in an open position of the closure, characterized in that the length of the fourth face perpendicular to the continuous folding line is shorter than half of the distance between the second pair of opposite side walls of the container, thereby providing an air opening to the interior of the container between the free edge of the fourth face and inwardly protruding peaks formed by folding of said first and second faces, the free edge of the third face being provided with an extension at its middle, which when the closure is sealed is arranged above the fourth face and when the closure is opened provides a non-drip spout, and the joint of the side walls of the container being arranged in a symmetrical axis of the third face.

2. A closure according to claim 1, wherein the third face has an underside, and the joint has an inner side on which a tape is provided, from the bottom of the container, on the underside of the third face and the extension and further above the surface of the fourth face to which the tape is releasably secured, so that an outer tip of the tape is free and easy to grip for opening of the closure from a sealed condition, and so that during opening of the closure, the tape is able to be torn off along suitable weakening lines on the underside of the third face, so as to be free from the closure.

3. A closure according to claim 1 or 2, characterized in that at least one locking lip constitutes an extension of the third face between the extension and an outer side edge of the third face, the at least one locking lip thereby being adapted, after a first opening of the closure, to be pressable below the free edge of the fourth face so as to lock the third face to the fourth face.

4. A closure according to claim 1 or 2, characterized in that the extension on the third face is adapted, after breaking the sealing of the closure, to be pressable below the free edge of the fourth face so as to lock the third face to the fourth face.

* * * * *